United States Patent [19]

Wagner et al.

[11] 4,214,469

[45] Jul. 29, 1980

[54] PROCESS AND DEVICE FOR THE PRODUCTION OF A COMPOSITE SECTION

[75] Inventors: Alfred Wagner, Steisslingen; Adolf Ames, Hilzingen-Duchtlingen, both of Fed. Rep. of Germany

[73] Assignee: Swiss Aluminium Ltd., Chippis, Switzerland

[21] Appl. No.: 898,659

[22] Filed: Apr. 21, 1978

[30] Foreign Application Priority Data

May 5, 1977 [DE] Fed. Rep. of Germany ..... 2720122

[51] Int. Cl.[3] ..... B21C 23/22; B21C 23/24; B21C 33/00

[52] U.S. Cl. ..... 72/258; 72/256; 72/262; 72/270

[58] Field of Search ..... 72/253, 256, 258, 262, 72/268, 269, 270, 261, 259; 425/224, 114, 325, 329; 29/149.5 S; 264/176 C

[56] References Cited

U.S. PATENT DOCUMENTS

| | | | |
|---|---|---|---|
| 1,197,326 | 9/1916 | Ackerman | 425/113 |
| 1,995,258 | 3/1935 | Stockfleth | 72/258 |
| 2,290,734 | 7/1942 | Brassert | 72/38 |
| 2,782,498 | 2/1957 | Mushovic et al. | 29/149.5 S |
| 3,532,576 | 10/1970 | Proctor et al. | 425/114 X |
| 3,702,497 | 11/1972 | Dion et al. | 72/256 |
| 3,824,825 | 7/1974 | Green | 72/262 |
| 3,911,705 | 10/1975 | Voorhes | 72/270 |
| 3,922,898 | 12/1975 | Voorhes | 72/262 |
| 3,934,446 | 1/1976 | Avitzur | 72/262 |
| 4,030,334 | 6/1977 | Wagner et al. | 72/258 |
| 4,041,595 | 8/1977 | Voorhes | 72/262 |
| 4,163,377 | 8/1979 | Moreau | 72/258 |

FOREIGN PATENT DOCUMENTS

| | | | |
|---|---|---|---|
| 2511301 | 9/1976 | Fed. Rep. of Germany | 72/258 |
| 2635304 | 2/1977 | Fed. Rep. of Germany | 72/262 |
| 402423 | 3/1974 | U.S.S.R. | 425/79 |

*Primary Examiner*—Lowell A. Larson
*Attorney, Agent, or Firm*—Bachman and LaPointe

[57] ABSTRACT

A process allows the production of composite sections made of at least two component parts such as conductor rails or the like having a beam like section with a facing in the form of a conductive metal strip. The process makes use of an extrusion die whereby at least one of the components of the composite section is fed to the die by means of frictional force on a face which moves continuously towards the die.

5 Claims, 7 Drawing Figures

PROCESS AND DEVICE FOR THE PRODUCTION OF A COMPOSITE SECTION

BACKGROUND OF THE INVENTION

The present invention concerns a process and a device for the production of a composite section made of at least two components parts, in particular the production of conductor rails or the like, comprising a beam-like section of light weight metal and a facing strip of a conductive material, shaped by extruding through a shape-giving die.

The present invention concerns a process and a device having a shaping tool for the production of a composite section made of at least two componet parts in particular by the extrusion of conductors or the like having a light-metal, beam-like section and a facing made of a conductive metal strip.

In known processes, at least one insert is introduced on both sides of the axis of the stream of metal, close to the extrusion die where the insert or inserts is/are encased in matrix metal due to pressure on all sides. In such a process the inserts are introduced, in the region of the die, radially into the stream of continuously extruded metal stream and symmetrical to the axis of this stream.

Such deflection of one of the two components of the section is often undesireable. The primary object of the present invention is to develop a process and a device of the kind described at the beginning, by means of which the production of composite sections is continuous but does not involve one of the component parts undergoing pronounced bending.

SUMMARY OF THE INVENTION

The foregoing object is fulfilled by way of the present invention in that at least one component section is fed continuously to the shaping tool by means of friction on a continuously moving surface, whereby each of the components can be conveyed to the shaping tool on the continuously moving surface specifically provided for that component part.

A device which has been found to be particularly, favorable for this purpose has a stationary shape-giving die and at least one continuous, moving surface which is in line, in front of the shaping die and on which a metal strip, which passes through the said die and in front of the die, delimits a shaping channel for a light metal matrix. At least one further, continuous, moving surface can be provided to partner the above mentioned moving surface.

The individual components of the section are fed to the shaping die in a continuously flowing stream and joined metallurgically in the shaping die; the structures of the different components engage strongly—amongst other things—as a result of the relative movement between the components of the section where the metal strip moves at a speed greater than the speed of the light metal matrix.

The result is a composite section the component parts of which are extremely well bonded to each other and do not experience large stresses or bending moments before extrusion takes place. Also, the component parts no longer pass through the complicated shaping dies used up to now, but instead are conveyed to the shaping die by the continuous, moving faces, the friction between the moving face and the metal strip having to be greater than that between the metal strip and the light-metal matrix so as to allow the strip to move at a speed greater than that of the matrix. It is possible to remove the resultant composite section from the shaping tool without any additional, auxiliary equipment.

The metal strip, or the harder of the components of the section, can serve simultaneously as a wall of the shaping tool; the extrusion channel is preferably open in part on one side and is accordingly completed there by that metal strip during extrusion.

If two wheels are employed, with their circumferencial faces facing each other, as friction wheel and counter wheel, then the components of the section can be fed synchronously together. It is however also conceivable to allow these components to be fed to the die by faces which run counter to each other.

However, it would then be necessary to deflect the stream of light weight metal in front of the die, to have both of the components running in the same direction in this region.

BRIEF DESCRIPTION OF THE DRAWINGS

A number of exemplified embodiments will now be explained with the help of the following drawings wherein.

DETAILED DESCRIPTION

Figure 1:
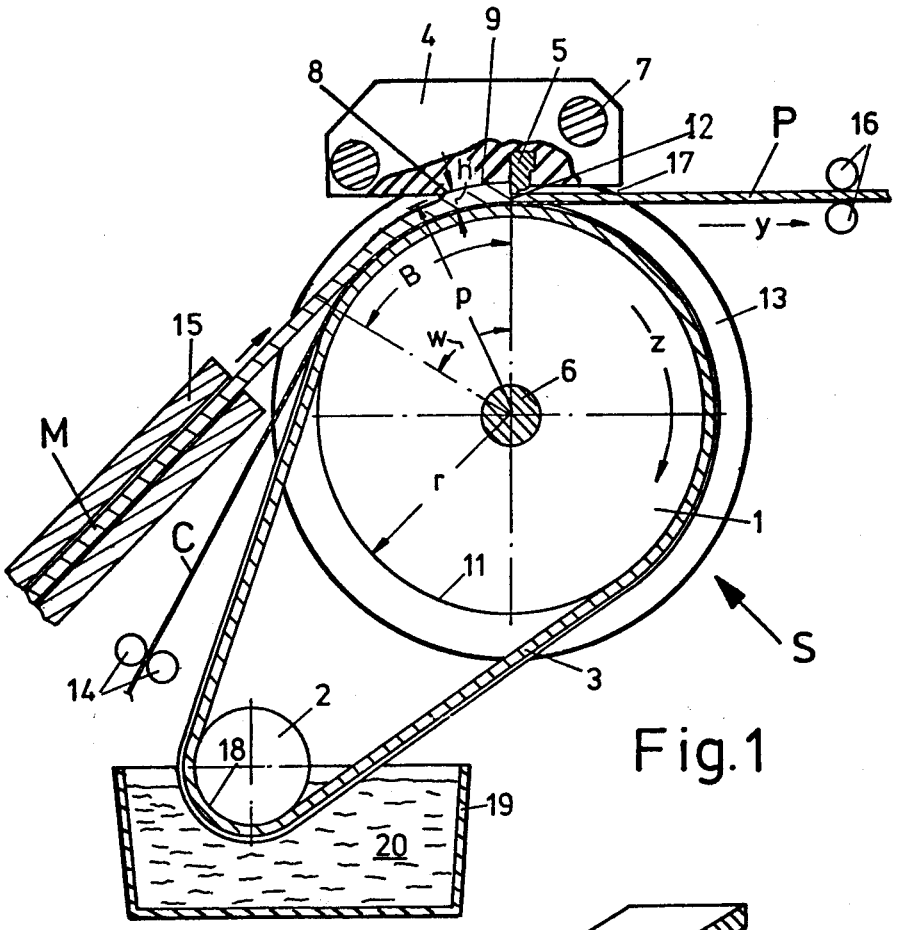
FIG. 1 is a schematic drawing of the side view of a device shown here partly in section.

An extrusion device S for the production of a composite section P has an endless belt 3 which is mounted on two rotatable discs 1, 2 and moves in direction z. Provided near the large disc 1 of radius r, for example 197 inches, is a shoe-like die holder 4 for a die or shaping tool 5 at a distance h from the belt 3.

The shoe 4 is mounted on sliding or holding rods 7 which run parallel to the axle 6 of the larger disc 1. The under side 8 of the shoe 4 is curved at the region 9 next to the die 5, the curvature being described by a radius p from the axle 6; this forms, together with a part B of the endless belt 3 described by an angle w of approx. 50° around the outer edge 11 of the larger disc 1, a channel which is delimited at the sides by the flanking walls 13 which are in other versions in the form of flanges on the disc 1.

A steel strip C is fed through rolls 14 to belt 3 and from there through the channel 12 to the die 5. Likewise a light metal matrix M is fed from pipe 15 to the channel 12 in which region it contacts the steel strip and at the end of the said channel 12 is taken through the die 5 in direction y by the steel strip.

Figure 2:
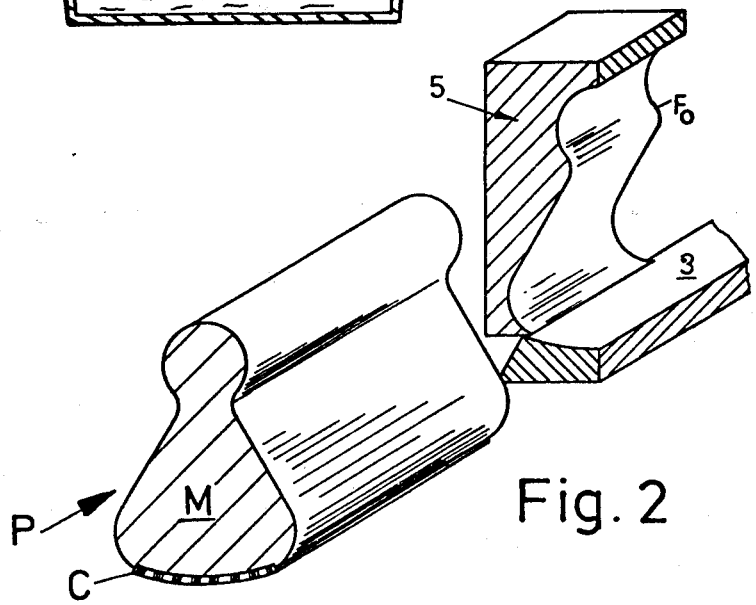
FIG. 2 is a perspective view of an enlarged detail from FIG. 1.

As FIG. 2 shows, the steel strip C delimits the die opening $F_o$ of the die 5 which is open towards the outer edge 11 of the disc 1.

The metallurgical bonding of the two section components, C, M takes place in the region of the die 5. The section P leaves the die 5 and is led away approx. horizontally through the exit channel 17, between powered rolls 16, without further assistance.

The strip 3 passes over the circumference 18 of the smaller disc 2 in which process it passes through a coolant 20 in a container 19.

In this process the exit speed of the composite section P is the same as the peripheral speed of the disc 1; the friction between the disc 1 or the belt 3 and the steel strip C must be greater than that between the strip C and the matrix M so that the strip C moves at a speed greater than the speed of the matrix M and equal to the speed of the extruded composite P.

Figure 3:
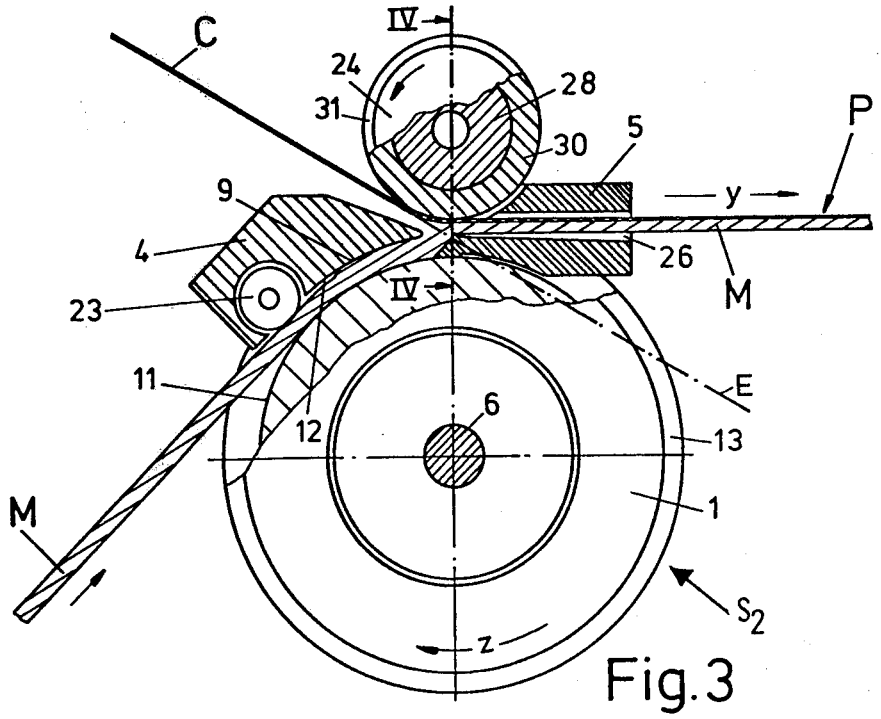
FIG. 3 is the same view as in FIG. 1, but showing another version of the device.

In the case of the exemplified embodiment $S_2$ shown in FIG. 3 the matrix M is taken by the periphery 11 of disc 1 and pressed onto this by a wheel 23 mounted in the shoe 4. Directly above disc 1 a friction wheel 24 turns the steel strip C moving the direction E tangential to the peripheral surface of the ring 30 of the friction wheel 24, and guides the steel strip C together with the matrix M which contacts the free surface 25 of the steel strip C to the die 5 and out of the channel 26, which the resultant composite section P leaves in an approx. horizontal plane.

Figure 4:
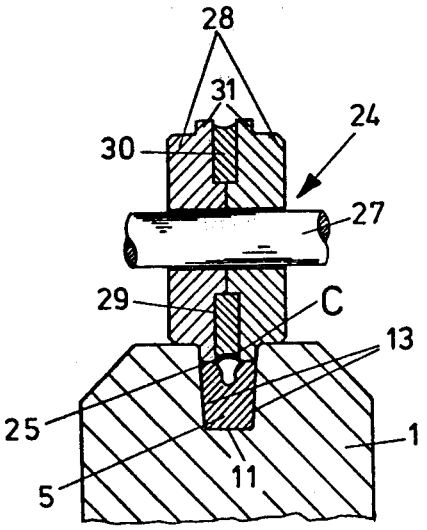
FIG. 4 is an enlarged view of the device shown in FIG. 3 sectioned along the line IV—IV in FIG. 3.

The friction wheel 24 on an axle 27 is made up of two discs 28 which form a groove 29 for a ring 30; as can be seen particularly well in FIG. 4, the steel strip C is led by this ring 30 between the flanges 31 on the wheel discs 28.

Here the exit speed of the composite section P can differ from the peripheral speed of the disc 1; the speed of movement of the ring 30 can be readily adjusted to the exit speed of the section.

Figure 6:
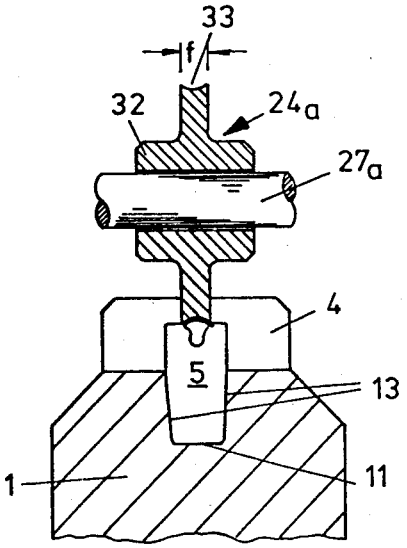
FIG. 6 is a section along VI—VI in FIG. 5, enlarged in comparison with FIG. 5.
Figure 5:
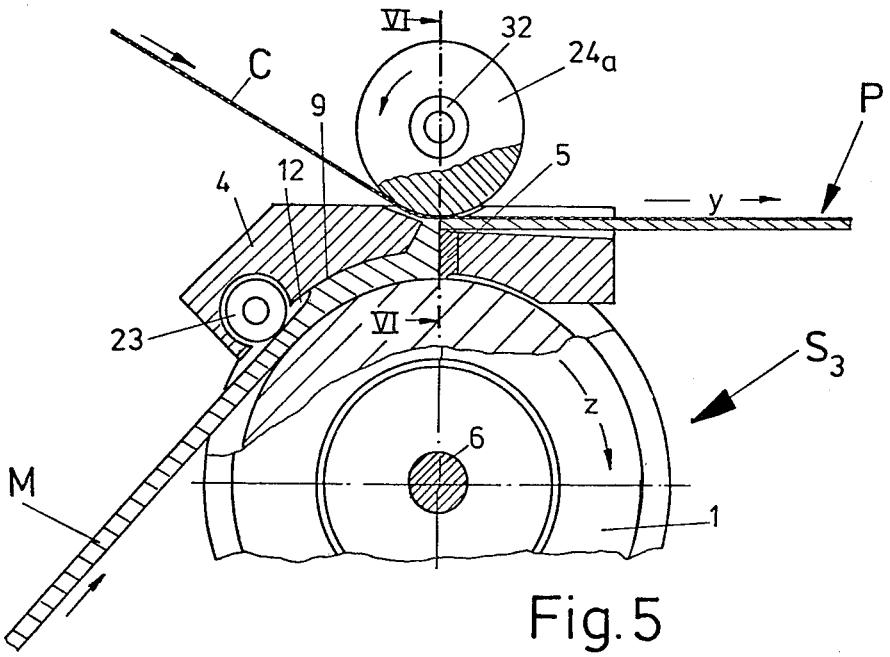
FIG. 5 is another exemplified embodiment showing a partly sectioned end view.
Figure 7:
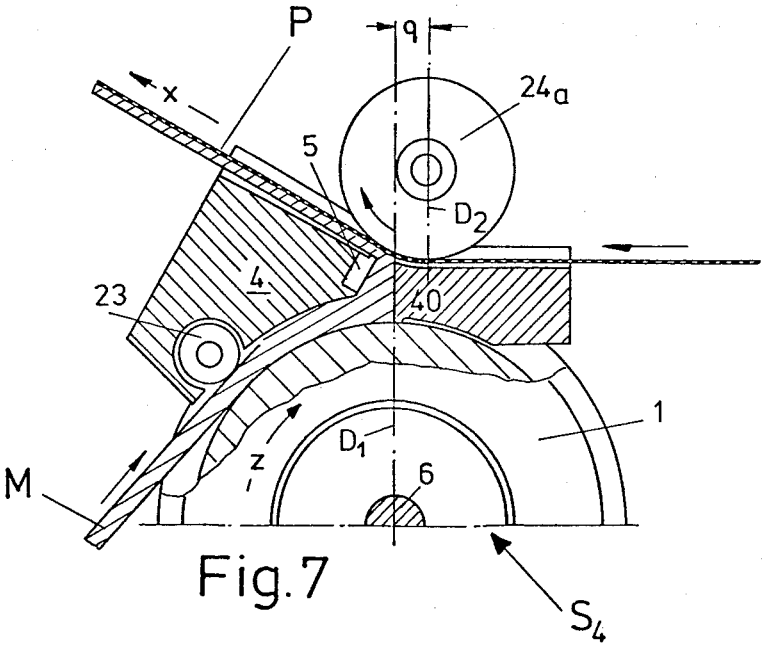
FIG. 7 is a part of another version of the device.

The friction wheel $24_a$ of device $S_3$ (FIGS. 5, 6) is shrunk with the hub 32 on to the axle $27_a$ and—projecting out from that hub—forms a narrow disc of breadth f with peripheral groove 33, which partly runs between the shoe 4, and leads the steel strip C with the matrix M through the die 5.

In device $S_4$ the composite section is made up of the matrix moving on disc 1 in direction z and the steel strip C which runs here in the counter direction (arrow x); the vertical middle axis $D_1$, of disc 1, which is extended by a deflection surface 40 of the shoe 4 for the matrix M, is displaced by an amount q with respect to the vertical middle axis $D_2$ of the friction wheel $24_a$. The die 5 lies in the drawing, on the left-hand side of the vertical middle axis $D_1$ of the disc 1.

We claim:

1. A process for the continuous extrusion of a composite metal section comprising a beam like section and a facing strip of another material which forms at least part of the surface of the beam like section, the beam like section of said composite is produced by extruding a metal matrix through a shape-giving opening in a stationary extrusion die, wherein said strip is fed to said stationary die at a first rate and said metal matrix is fed to said stationary die at a second rate less than said first rate by one endless face which moves continuously toward said stationary die so as to form said composite section.

2. A process according to claim 1 wherein said strip is fed to said stationary die by means of the frictional force between said strip and said one endless face.

3. A process according to claim 2 wherein a frictional force between said strip and said endless face is greater than a frictional force between said strip and said metal matrix.

4. A device for the continuous extrusion of a composite metal section comprising a beam like section and a facing strip of another material, which comprises at least one stationary die and a die opening for extruding said beam like metal section from a metal matrix, one continuous endless moving means for feeding said facing strip to said at least one stationary die at a first rate and said metal matrix to said at least one stationary die at a second rate greater than said first rate such that said facing strip completes said die opening and delimits the shape of said die opening for said metal matrix.

5. A device according to claim 4 wherein said one continuous endless moving means consists of a belt mounted for rotation on a pair of rollers.

* * * * *

UNITED STATES PATENT AND TRADEMARK OFFICE

CERTIFICATE OF CORRECTION

PATENT NO. : 4,214,469

DATED : July 29, 1980

INVENTOR(S) : Alfred Wagner and Adolf Ames

It is certified that error appears in the above-identified patent and that said Letters Patent are hereby corrected as shown below:

In Column 4, line 21, claim 2, change "the" to --a--.

Signed and Sealed this

*Fourteenth* Day of *October 1980*

[SEAL]

*Attest:*

SIDNEY A. DIAMOND

*Attesting Officer*

*Commissioner of Patents and Trademarks*